US009267682B2

(12) United States Patent
Chang

(10) Patent No.: US 9,267,682 B2
(45) Date of Patent: Feb. 23, 2016

(54) APPARATUS TO CHANGE LIQUID LIGHT AROMATIC HYDROCARBON INTO GASEITY

(71) Applicant: LI-YE ENVIRONMENTAL PROTECTION TECHNOLOGY CO., LTD., Taoyuan County (TW)

(72) Inventor: Li-Yu Chang, Taoyuan County (TW)

(73) Assignee: LI-YE ENVIRONMENTAL PROTECTION, Taoyuan County (TW)

( * ) Notice: Subject to any disclaimer, the term of this patent is extended or adjusted under 35 U.S.C. 154(b) by 294 days.

(21) Appl. No.: 14/045,947

(22) Filed: Oct. 4, 2013

(65) Prior Publication Data

US 2014/0103139 A1 Apr. 17, 2014

(30) Foreign Application Priority Data

Oct. 11, 2012 (TW) ..... 101219611 A

(51) Int. Cl.

| | |
|---|---|
| ***B01J 7/00*** | (2006.01) |
| ***F23D 11/44*** | (2006.01) |
| ***F23D 14/02*** | (2006.01) |
| ***F23K 5/22*** | (2006.01) |

(52) U.S. Cl.

CPC ..... *F23D 11/44* (2013.01); *F23D 14/02* (2013.01); *F23K 5/22* (2013.01)

(58) Field of Classification Search

CPC ..... F23D 11/44; F23D 14/02; F23K 5/22

See application file for complete search history.

(56) References Cited

U.S. PATENT DOCUMENTS

| | | | | | |
|---|---|---|---|---|---|
| 4,331,456 | A | * | 5/1982 | Schwartz et al. | 95/93 |
| 4,343,629 | A | * | 8/1982 | Dinsmore et al. | 95/93 |
| 4,510,913 | A | * | 4/1985 | deCelle | 123/557 |
| 4,550,706 | A | * | 11/1985 | Hoffman | 123/549 |
| 2011/0247593 | A1 | * | 10/2011 | Yoshizaki et al. | 123/520 |

* cited by examiner

*Primary Examiner* — Imran Akram

(74) *Attorney, Agent, or Firm* — Jackson IPG PLLC; Demian K. Jackson

(57) ABSTRACT

An apparatus to change liquid light aromatic hydrocarbon into gaseity includes a gas storage barrel, two gas generation barrels and two gas connection pipes connected between the gas storage barrel and the respective gas generation barrels to form a "π" shape. Each gas generation barrel includes a light aromatic hydrocarbon filling pipe, an air supply pipe, an air intake pipe, an aeration pipe, and a heating member. A liquid communicating pipe is connected between the two gas generation barrels. The apparatus of the present invention is to mix and gasify liquid fuel, such as ether or alkanes, and air as combustion gas. During heating, the fuel can be resupplied to stable the quality of the output gas.

9 Claims, 3 Drawing Sheets

APPARATUS TO CHANGE LIQUID LIGHT AROMATIC HYDROCARBON INTO GASEITY

BACKGROUND OF THE INVENTION

1. Field of the Invention

The present invention relates to an apparatus to change liquid light aromatic hydrocarbon into gaseity, and more particularly, to an apparatus which uses liquid fuel, such as ether or alkanes, and air to be mixed and gasified as combustion gas.

2. Description of the Prior Art

These days, liquid aromatic hydrocarbon is changed into gaseity for fuel. By using its low boiling point, the hydrocarbon is gasified and vaporized to become gas for fuel gas. The fuel is mixed with air and gasified in a single fuel barrel so the user must consider safety, the fuel concentration, the amount of the solvent and leak during mixing process. As shown in FIG. 1, a barrel 9 has an inner space 91. The barrel is provided with a solvent level gauge 911, a drain outlet 92, a drain outlet 93, a heater 94, an output end 95, a safety valve 96, a thermometer 97, a pressure gauge 98 and a pressure valve 99 and cooperates with a compressor unit 8. The compressor unit 8 comprises a compressor 81, an air intake pipe 82, and a nebulization nozzle 83. The principle is to pour a certain fuel into the barrel 9, and the fuel is mixed with the air in the barrel. After that, the combustible gas is collected and sent through the output end 95 for fuel use. In this way, the temperature of the fuel in the barrel 9 will be influenced by the gas to absorb heat so the temperature drops. When the temperature of the fuel is lowered to a certain level, it is not easy to gasify the fuel and the fuel cannot be resupplied when heating, so that the quality and concentration of the gas is not stable.

Accordingly, the inventor of the present invention has devoted himself based on his many years of practical experiences to solve these problems.

SUMMARY OF THE INVENTION

The primary object of the present invention is to provide an apparatus to change liquid light aromatic hydrocarbon into gaseity to overcome the shortcomings of the prior art, for example, the safety is not good, it is not easy to control the concentration and the amount of the solvent, the gas may leak or the like. The primary of the present invention is to heat, mix and gasify liquid light aromatic hydrocarbon, such as ether or alkanes, and air as combustion gas. Compared to the prior art, the present invention has better safety and the gas concentration and the amount of the solvent can be controlled easily.

In order to achieve the aforesaid object, the apparatus to change liquid light aromatic hydrocarbon into gaseity of the present invention comprises a gas storage barrel, two gas generation barrels and two gas connection pipes. The two gas connection pipes are connected between the gas storage barrel and the respective gas generation barrels. The gas storage barrel has a space therein and a gas outlet valve. Each gas generation barrel has a fuel storage area therein and a light aromatic hydrocarbon filling pipe extending to the fuel storage area. The gas generation barrel is inserted with an air supply pipe. The bottom of the gas generation barrel is provided with a heating member and an aeration pipe. The outer end of the aeration pipe is connected with an air intake pipe. The two gas connection pipes are connected between the gas storage barrel and the respective gas generation barrels so that the gas storage barrel and the two gas generation barrels are assembled to form a "π" shape.

Preferably, the gas storage barrel is located above the two gas generation barrels.

Preferably, the fuel storage area is provided with a lower density filter, a middle density filter and a high density filter arranged in sequence from bottom to top.

Preferably, the outer wall of the gas generation barrel is wrapped with heat preservation cotton.

Preferably, the gas generation barrel is provided with an external liquid communicating pipe. The external liquid communicating pipe comprises a high level detector and a low level detector. A liquid communicating pipe is connected between the two gas generation barrels.

Preferably, the fuel storage area is provided with a lower density filter, a middle density filter and a high density filter arranged in sequence from bottom to top. The gas generation barrel is provided with a light aromatic hydrocarbon filling pipe which is inserted from the top of the gas generation barrel and extends close to the bottom of the fuel storage area. The top of the gas generation barrel is provided with an air supply pipe to mix with air.

Preferably, the gas storage barrel is a hollow barrel and communicates with the two gas generation barrels through the two connection pipes. The gas storage barrel has a gas outlet valve to output gas. The gas storage barrel is provided with a pressure switch, an over-pressure switch, a combustion concentration detector, a lightning detector, a carbon dioxide detector, an external gas communicating port, an oxygen detector and a vibration detector.

Preferably, the apparatus further comprises a stylization automatic control unit.

Preferably, the apparatus further comprises a compressor. The compressor comprises an air detector, a steam detector and an oxide film.

Preferably, the apparatus further comprises a leak detector.

Preferably, the gas generation barrel is provided with a drain valve, a temperature detector and an over-temperature detector. The bottom of the gas generation barrel is provided with a base. The gas generation barrel is provided with a vibration detector located at the lower outside of the gas generation barrel.

DETAILED DESCRIPTION OF THE PREFERRED EMBODIMENTS

Embodiments of the present invention will now be described, by way of example only, with reference to the accompanying drawings.

Figure 1:
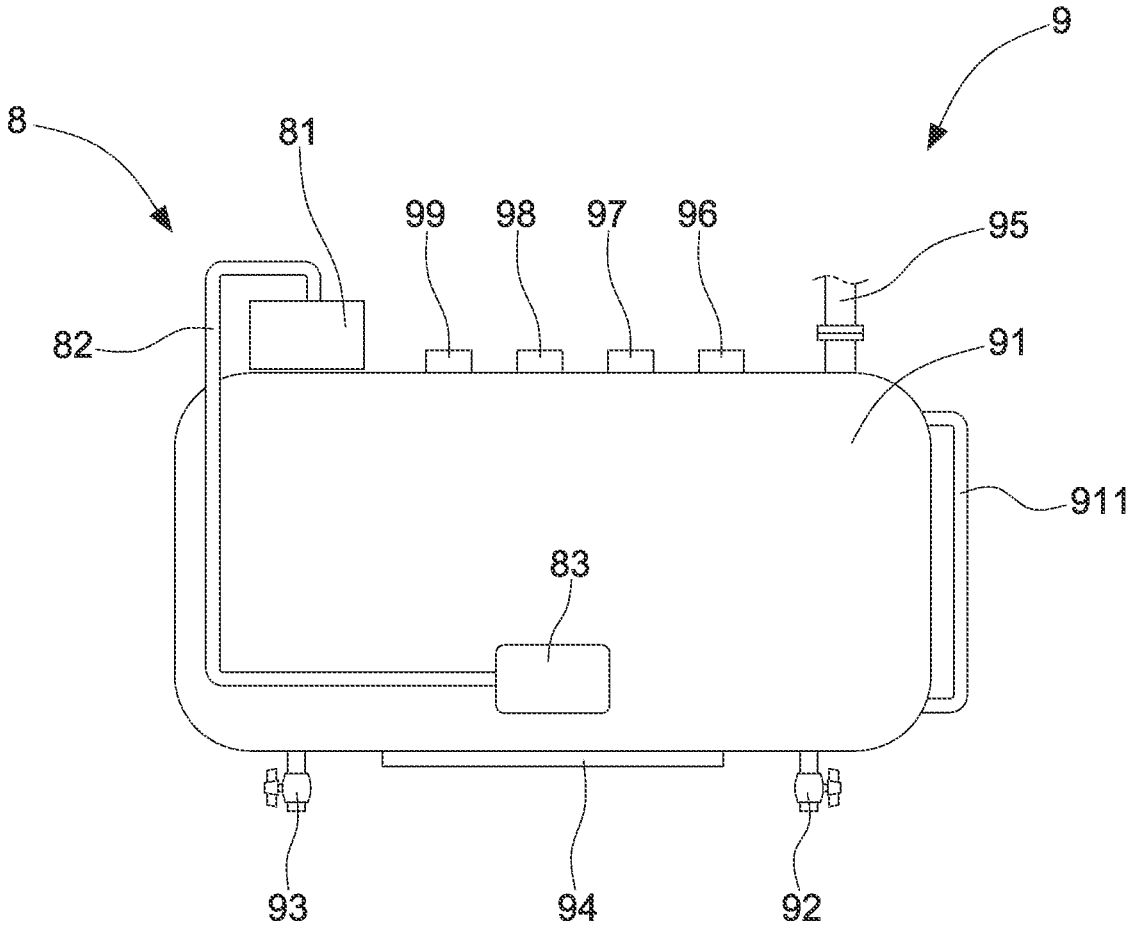
Fig.1 (Prior Art)
FIG. 1 is a schematic view of a conventional apparatus.
Figure 2:
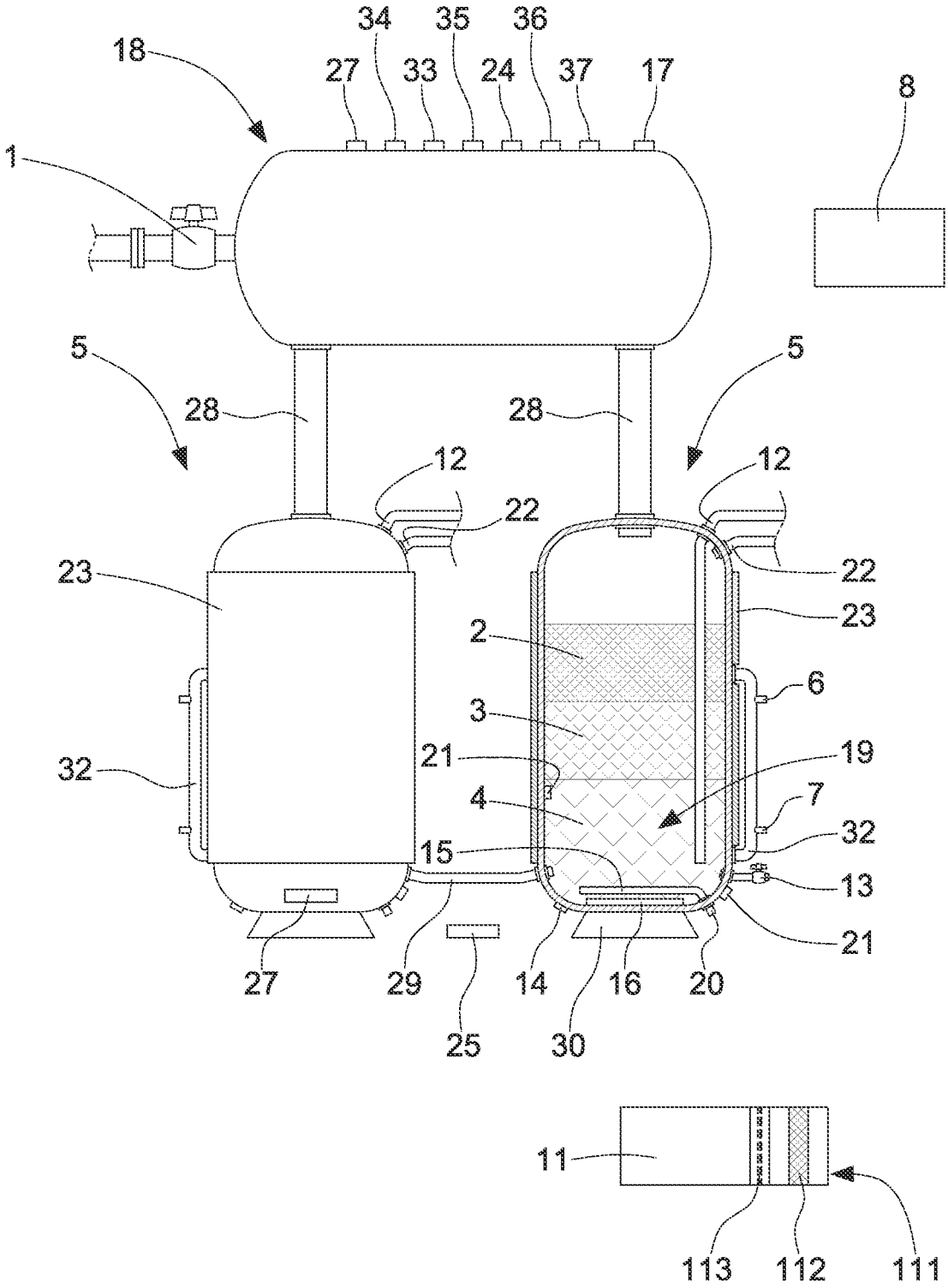
FIG. 2 is a schematic view of the present invention.

As shown in FIG. 2, the apparatus to change liquid light aromatic hydrocarbon into gaseity of the present invention comprises a gas storage barrel 18, two gas generation barrels 5 and two gas connection pipes 28. The two gas connection pipes 28 are connected between the gas storage barrel 18 and the respective gas generation barrels 5. The gas storage barrel 18 is located above the two gas generation barrels 5 so that the gas storage barrel 18 and the two gas generation barrels 5 are assembled to form a "π" shape.

Each gas generation barrel 5 has a hollow inside and a fuel storage area 19 therein. The lower central portion of the fuel storage area 19 is provided with a heating member 16 and an aeration pipe 15 above the heating member 16. An outer end of the aeration pipe 15 is connected with an air intake pipe 20. The fuel storage area 19 is provided with a lower density filter 4, a middle density filter 3 and a high density filter 2 arranged in sequence from bottom to top. The gas generation barrel 5 is provided with a light aromatic hydrocarbon filling pipe 12 which is inserted from the top of the gas generation barrel 5 and extends close to the bottom of the fuel storage area 19. The top of the gas generation barrel 5 is provided with an air supply pipe 22 to mix with air. The outer wall of the gas generation barrel 5 is wrapped with heat preservation cotton 23. The gas generation barrel 5 is provided with an external liquid communicating pipe 32. The external liquid communicating pipe 32 comprises a high level detector 6 and a low level detector 7. The gas generation barrel 5 is provided with a drain valve 13, a temperature detector 21, and an over-temperature detector 14. The bottom of the gas generation barrel 5 is provided with a base 30. A liquid communicating pipe 29 is connected between the two gas generation barrels 5. The gas generation barrel 5 is provided with a vibration detector 27 located at the lower outside of the gas generation barrel 5.

The gas storage barrel 18 is a hollow barrel and communicates with the two gas generation barrels 5 through the two connection pipes 28. The gas storage barrel 18 has a gas outlet valve 1 to output gas. The gas storage barrel 18 is provided with a pressure switch 17, an over-pressure switch 37, a fuel concentration detector 36, a lightning detector 24, a carbon dioxide detector 35, an external gas communicating port 35, an oxygen detector 34 and a vibration detector 27.

The present invention further comprises a stylization automatic control unit 8 to integrate all the detectors. The present invention further comprises a compressor 11. The compressor 11 comprises an air detector 113, a steam detector 111, and an oxide film 112. The compressor 11 supplies air to the air supply pipe 22. The present invention further comprises a leak detector 25.

Figure 3:
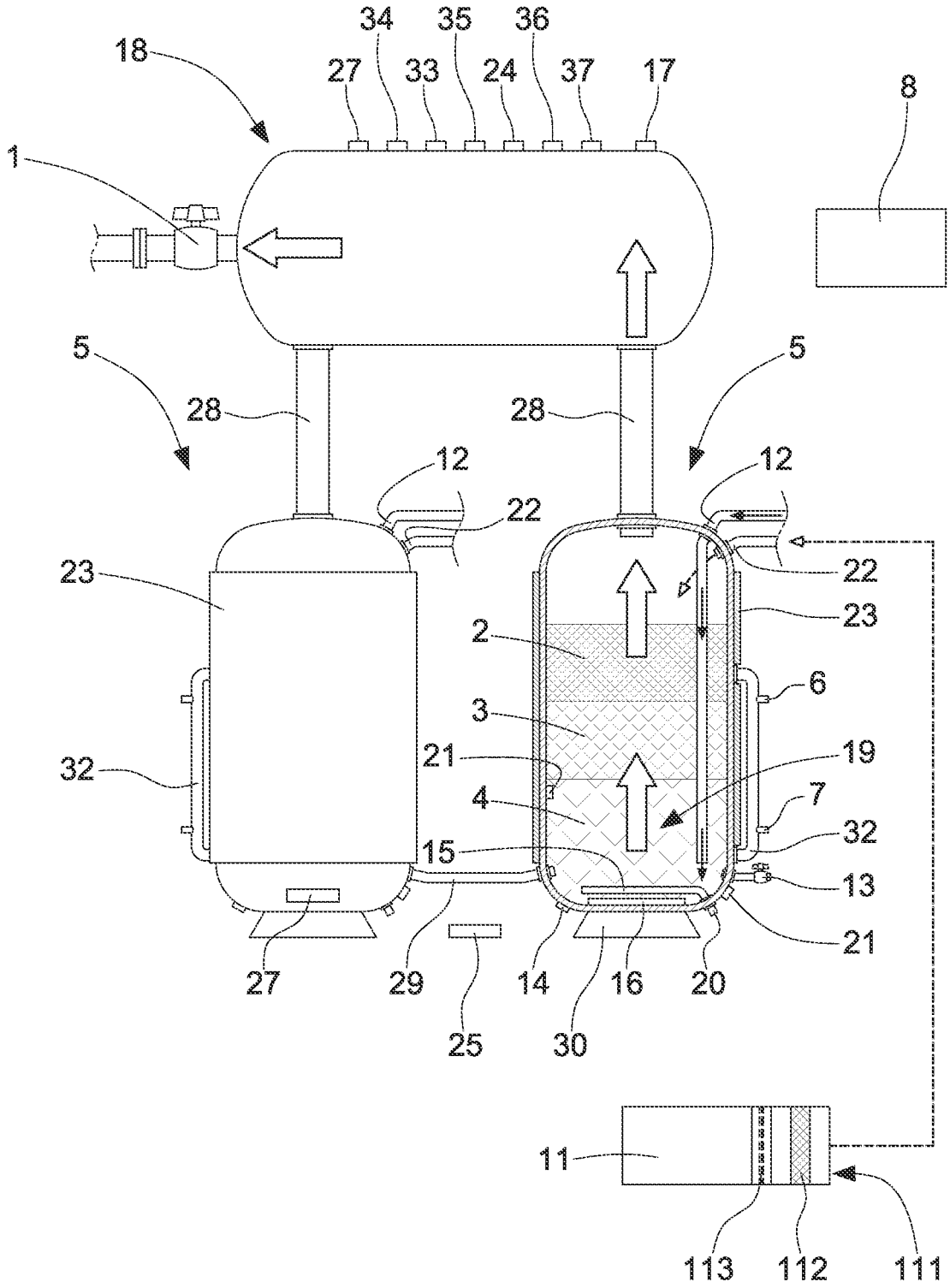
FIG. 3 is a schematic view of the present invention when in use.

To practice the present invention, as shown in FIG. 3, the liquid light aromatic hydrocarbon, such as ether or alkanes, is poured into the gas generation barrel 5 through the light aromatic hydrocarbon filling pipe 12, and the compressor 11 supplies high-pressure air to the gas generation barrel 5 through the air supply pipe 22. Through the heating member 16 to heat and the aeration pipe 15 to aerate, the liquid light aromatic hydrocarbon is mixed and gasified to be sent and stored in the gas storage barrel 18 through the gas connection pipes 28. Finally, the gas is output through the gas outlet valve 1.

The present invention uses the stylization automatic control unit 8 and cooperates the high level detector 6 and the low level detector 7 provided on the external liquid communicating pipe 32 to supply fuel automatically when the fuel inside the gas generation barrel 5 is too less.

The "π" shaped apparatus of the present invention can be connected in series as desired.

Accordingly, the gas storage barrel 18 and the two gas generation barrels 5 of the present invention are individually provided, so that the process to change liquid into gaseity and storage are separated to overcome the aforesaid shortcomings of the prior art.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An apparatus to change liquid light aromatic hydrocarbon into gaseity, comprising:

a gas storage barrel, the gas storage barrel having a space therein and a gas outlet valve;

two gas generation barrels, each gas generation barrel having a fuel storage area therein and a light aromatic hydrocarbon filling pipe extending to the fuel storage area, each gas generation barrel being provided with an air supply pipe, a bottom of each gas generation barrel being provided with a heating member and an aeration pipe, an outer end of the aeration pipe being connected with an air intake pipe; and two gas connection pipes, the two gas connection pipes being connected between the gas storage barrel and the respective gas generation barrels to form a "π" shape;

wherein the fuel storage area is provided with a lower density filter, a middle density filter and a high density filter arranged in sequence from bottom to top.

2. The apparatus to change liquid light aromatic hydrocarbon into gaseity as claimed in claim 1, wherein the gas storage barrel is located above the two gas generation barrels.

3. The apparatus to change liquid light aromatic hydrocarbon into gaseity as claimed in claim 1, wherein an outer wall of each gas generation barrel is wrapped with heat preservation cotton.

4. The apparatus to change liquid light aromatic hydrocarbon into gaseity as claimed in claim 1, wherein each gas generation barrel is provided with an external liquid communicating pipe, the external liquid communicating pipe comprises a high level detector and a low level detector, and a liquid communicating pipe is connected between the two gas generation barrels.

5. The apparatus to change liquid light aromatic hydrocarbon into gaseity as claimed in claim 1, wherein each gas storage barrel is provided with a pressure switch, an over-pressure switch, a combustion concentration detector, a lightning detector, a carbon dioxide detector, an external gas communicating port, an oxygen detector, and a vibration detector.

6. The apparatus to change liquid light aromatic hydrocarbon into gaseity as claimed in claim 1, further comprising a stylization automatic control unit.

7. The apparatus to change liquid light aromatic hydrocarbon into gaseity as claimed in claim 1, further comprising a compressor, and the compressor comprises an air detector, a steam detector and an oxide film.

8. The apparatus to change liquid light aromatic hydrocarbon into gaseity as claimed in claim 1, further comprising a leak detector.

9. The apparatus to change liquid light aromatic hydrocarbon into gaseity as claimed in claim 1, wherein each gas generation barrel is provided with a drain valve, a temperature detector and an over-temperature detector, the bottom of each gas generation barrel is provided with a base, and each gas generation barrel is provided with a vibration detector located at a lower outside of the gas generation barrel.

* * * * *